US005409387A

United States Patent [19]

Northey et al.

[11] Patent Number: 5,409,387

[45] Date of Patent: Apr. 25, 1995

[54] CONNECTOR WITH PASSIVE SWITCH FOR ELECTROSTATIC DISCHARGE

[75] Inventors: William A. Northey, Etters; Harold W. Sundy, Landisburg, both of Pa.

[73] Assignee: Berg Technology, Inc., Reno, Nev.

[21] Appl. No.: 108,052

[22] Filed: Aug. 17, 1993

[51] Int. Cl.[6] ..... H01R 13/703

[52] U.S. Cl. ..... 439/188; 200/51.1

[58] Field of Search ..... 439/188, 620; 200/51.1

[56] References Cited

U.S. PATENT DOCUMENTS

| | | | |
|---|---|---|---|
| 4,034,172 | 7/1977 | Glover et al. | 439/188 |
| 4,068,915 | 1/1978 | Evans | 439/637 |
| 4,224,486 | 9/1980 | Zimmerman, Jr. | 200/51.1 |
| 4,358,135 | 11/1982 | Tsuge et al. | 439/188 |
| 4,585,284 | 4/1986 | Koser et al. | 439/76 |
| 4,587,002 | 8/1989 | Jensen et al. | 439/76 |
| 4,687,888 | 8/1987 | Hasircoglu | 200/51.1 |
| 4,952,758 | 8/1990 | Dara et al. | 439/188 |
| 4,954,087 | 9/1990 | Lauks et al. | 439/188 |
| 4,993,957 | 2/1991 | Shino | 439/86 |
| 5,086,284 | 2/1992 | Mouissie | 335/205 |

OTHER PUBLICATIONS

*EST Protective Serpentine Block Design,* reproduced from *Research Disclosure,* Feb. 1991, No. 322, Kenneth Mason Publications Ltd., England.

*Silver Zebra® Low Resistance Elastomeric Connections Product Description and Design Recommendations,* Fujipoly, Inc. of Cranford, N.J.

*Primary Examiner*—Neil Abrams

*Attorney, Agent, or Firm*—Woodcock Washburn Kurtz Mackiewicz & Norris

[57] ABSTRACT

An anti-electrostatic discharge electrical connector assembly (10) includes a housing (12, 18), a plurality of terminals (14, 20) supported in the housing, and a grounding system (36) for electrically connecting at least a group of the terminals to ground when the connector (10) is not fully mated to a mating connector. In the preferred embodiment, the grounding system (36) includes a printed circuit board (26) that is in contact with the terminals (20) and has a grounding area thereon, a conductive grounding bar (48) that is biased into contact with the grounding area (38), and a camming system (54, 60) for moving the grounding bar away from the grounding area when the connector assembly is substantially fully mated with a mating connector or interface. When the assembly (10) is connected to a mating connector or interface, ally electrostatic discharges will be passed to ground through the terminals, the grounding area and the ground bar.

6 Claims, 4 Drawing Sheets

CONNECTOR WITH PASSIVE SWITCH FOR ELECTROSTATIC DISCHARGE

BACKGROUND OF THE INVENTION

1. Field of the Invention

This invention relates to electrical connectors, and more particularly, to an interposer four connecting a cable to a cable interface in an electronic system that is designed to ground any electrostatic discharges that might take place during connection of the interposer to the cable or the cable interface.

2. Description of the Prior Art

Multi-terminal electrical connectors are used in modern electronic equipment, such as computers, for connecting various electronic components, such as printers, memory units, display units, etc., to another unit, such as a central processor of a computer. A main frame computer system may have several such components connected to its central processor. Plug-type connectors are particularly suited for use with modular system designs, and allow quick and easy assembly, disassembly and reconfiguration of a modular system.

An interposer is a unit for facilitating a multi-terminal electrical connection between, for example, a first connector that is provided at the end of a cable, and a connector interface that is provided on a component, such as a central processor of a computer. By using an interposer to make and break the connection, wear on the connector and connector interfaces is reduced. An interposer will typically include a housing, a first set of terminals for mating with the first connector, and a second set of terminals for mating with the cable interface.

One problem that can be encountered in cable-connected modular electronic systems results from a build-up of electrostatic potential between different components and their connectors. When terminals in a first connector have a different level of electrical potential than terminals of a mating connector do, an electrostatic discharge may take place between the connectors before or during connection. Electronic computers and their components are particularly sensitive to such electrostatic discharges. In some cases, even system malfunction or failure can result.

It is clear that there has existed a long and unfilled need in the prior art for an improved electrical connector that can prevent damage to sensitive electronic equipment as a result of electrostatic discharges that may take place during connection with a mating connector.

SUMMARY OF THE INVENTION

Accordingly, it is an object of this invention to provide an improved electrical connector assembly that is constructed to route any electrostatic discharges that may take place during connection to ground.

It is further an object of the invention to provide an anti-electrostatic discharge electrical connector assembly that is relatively simple in construction, inexpensive to manufacture, and reliable in operation.

In order to achieve the above and other objects of the invention, an electrostatic discharge interposer for connecting a cable to a cable interface in an electronic system includes, according to a first aspect of the invention, a housing; a first plurality of terminals supported in the housing, the first housing and the first plurality of terminals being constructed and arranged to mate with a mating connector; a second plurality of terminals supported in the housing, the housing and the second plurality of terminals being constructed and arranged to mate with a connector interface; a connecting system for electrically connecting the first plurality of terminals, respectively, to the second plurality of terminals in a predetermined relationship, the housing and the connecting system being secured together as an integral unit; and a grounding system for electrically connecting at least a group of the connected terminals to ground when the housing is not fully mated to one of the connector interface or mating connector, the grounding system including a mechanical system for disconnecting the group of connected terminals from ground when the housing is substantially fully mated to the one of the connector interface or mating connector, whereby any electrostatic discharges will be grounded during connection of the respective connector interface or mating connector to the interposer.

According to a second aspect of the invention, an anti-electrostatic discharge electrical connector assembly for connecting to a mating connector includes a housing; a plurality of terminals supported in the housing, the housing and the terminals being constructed and arranged to mate with a mating connector; and a grounding system for electrically connecting at least a group of the terminals to ground when the connector is not fully mated to a mating connector, whereby any electrostatic discharges will be grounded during connection of the connector assembly to a mating connector.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
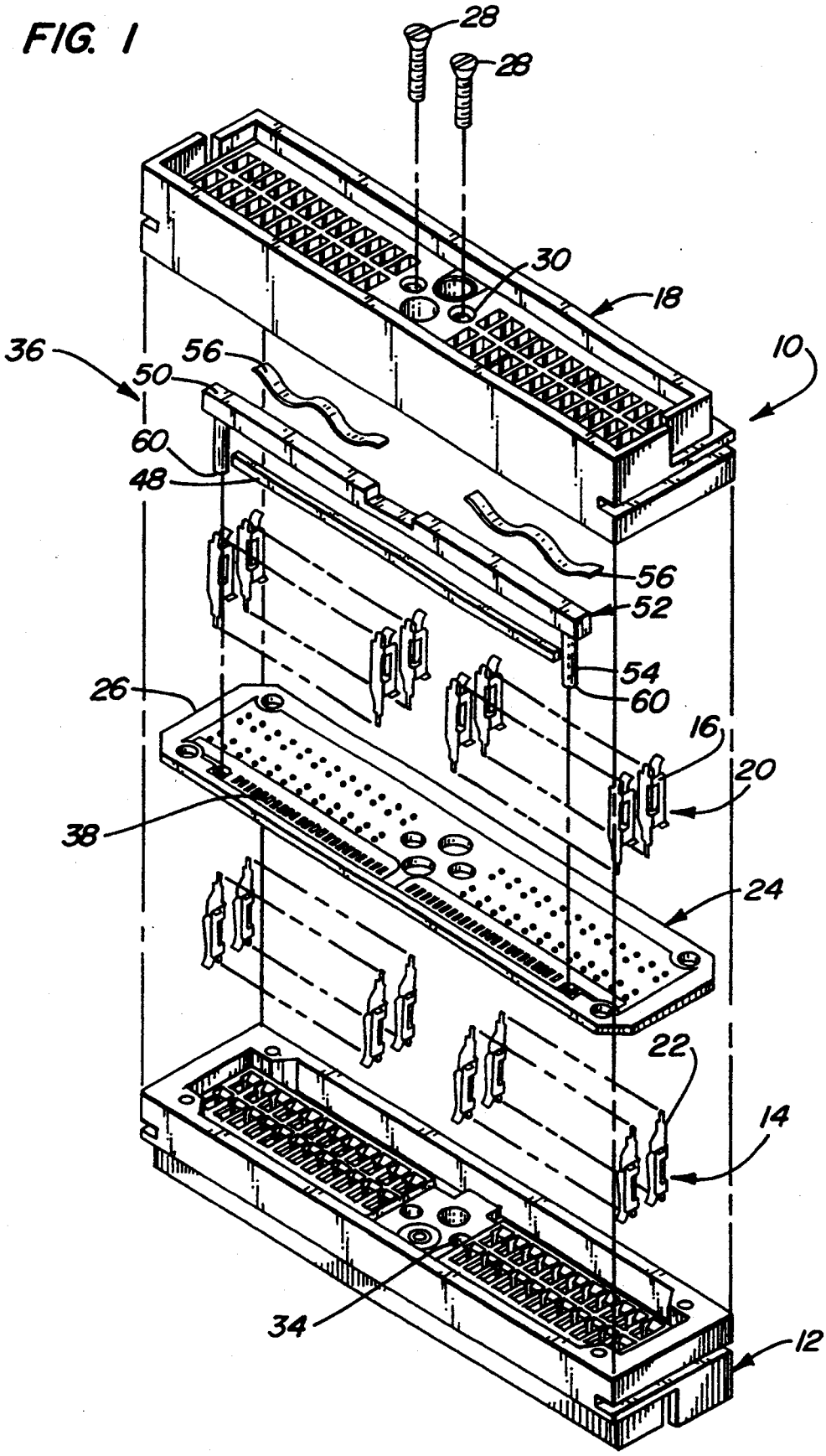
FIG. 1 is a first exploded perspective view of an interposer that is constructed according to a preferred embodiment of the invention.
Figure 3:
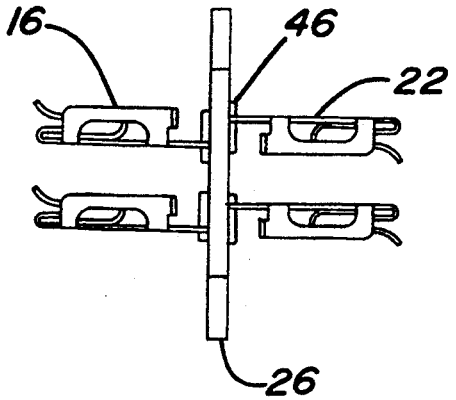
FIG. 3 is a side elevational view of one component in the system that is depicted in FIGS. 1.

Referring now to the drawings, wherein like reference numerals designate corresponding structure throughout the views, and referring in particular to FIGS. 1 and 3, an anti-electrostatic discharge interposer 10 for connecting a mating connector to a connector interface in an electronic system, such as a computer system, includes a first housing 12, which has a first plurality 14 of terminals 16 supported therein. Interposer 10 also includes a second housing 18 that has a second plurality 20 of terminals 22 supported therein in a manner that is similar to the relationship between the first plurality of terminals 14 and first housing 12. Second housing 18 is constructed and arranged to mate with a connector interface, such as might be provided on a central processor of a main frame computer system.

Referring again to FIG. 1, interposer 10 further includes a terminal connecting system 24, that is embodied as a printed circuit board 26 having holes defined therein for accepting the tapered ends of terminals 16, 22. The connecting system also includes a pair of self-tapping screws 28, which are threaded, respectively, through a pair of holes 30 and second housing 18, a pair of matching holes 32 defined in circuit board 26, and another matching pair of holes 34 that are provided in first housing 12. When tightly fastened, screws 28 thus secure the first housing 12, the second housing 18 and the printed circuit board 26 together as an integral unit.

According to one novel aspect of the invention, interposer 10 further includes a novel grounding system 36 for electrically connecting at least a group of the connected terminals 16, 22 to ground when one of the first or second housings 12, 18 is not fully mated to its respective mating connector or connector interface, respectively. Grounding system 36 includes a mechanical actuator 52 for disconnecting the group of connected terminals from ground when the one of the first or second housings 12, 18 is substantially mated to its respective mating connector or connector interface. As a result, any electrostatic discharges that take place during connection will be grounded, and will not be passed on to any sensitive electronic equipment that could be damaged by such a discharge. In the illustrated embodiment, grounding system 36 is constructed to connect a group of the connected terminals 16, 22 to ground when second housing 18 is not fully mated with a mating connector interface, as will be discussed in greater detail below.

Figure 4:
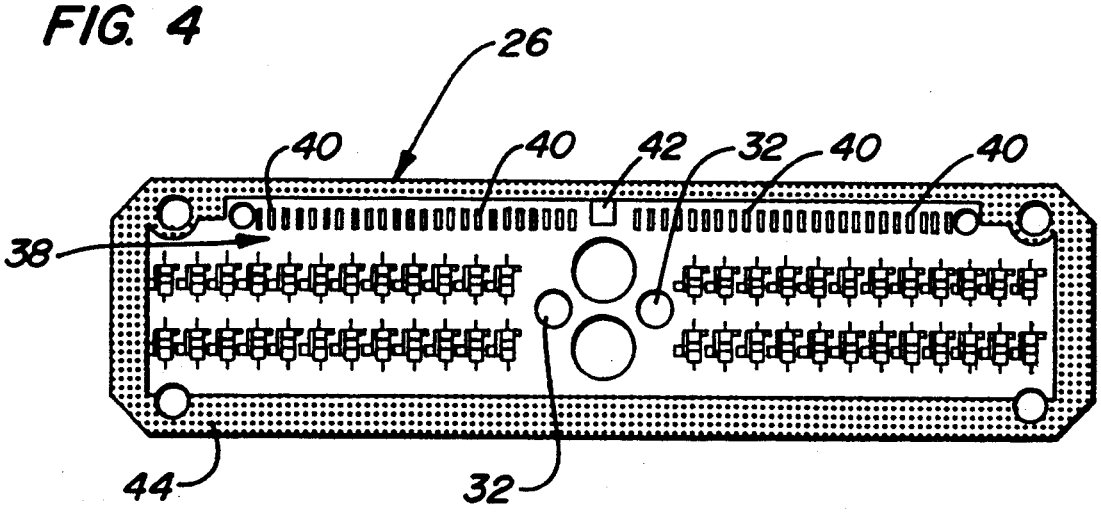
FIG. 4 is a top plan view of one of the components in the system that is depicted in FIGS. 1–3.

Referring in particular to FIGS. 1 and 4, grounding system 36 includes, in the preferred embodiment, a grounding contact area 38 that is defined on printed circuit board 26. Grounding contact area 38, as may best be seen in FIG. 4, includes a plurality of terminal contacts 40 that are arranged in a linear path along one edge of the printed circuit board 26. In the preferred embodiment, each of the terminal contacts 40 is electrically connected, through known printed circuit board manufacturing techniques, to a terminal pair that includes a terminal 16 from the first plurality of terminals 14 and a terminal 22 from the second plurality of terminals 20. As shown in FIG. 3, each terminal. 16 is preferably connected to a terminal 22 by means of a solder connection 46. Referring back to FIG. 4, it will be seen that grounding contact area 38 on printed circuit board 26 further includes a ground contact 42 that is contiguous with a plated area 44 on printed circuit board 26 that is adapted to be connected to a system ground through plated-through holes that are provided on the printed circuit board 26. Grounding is also effected by the fact that certain of the terminals are normally connected to ground.

Figure 2:
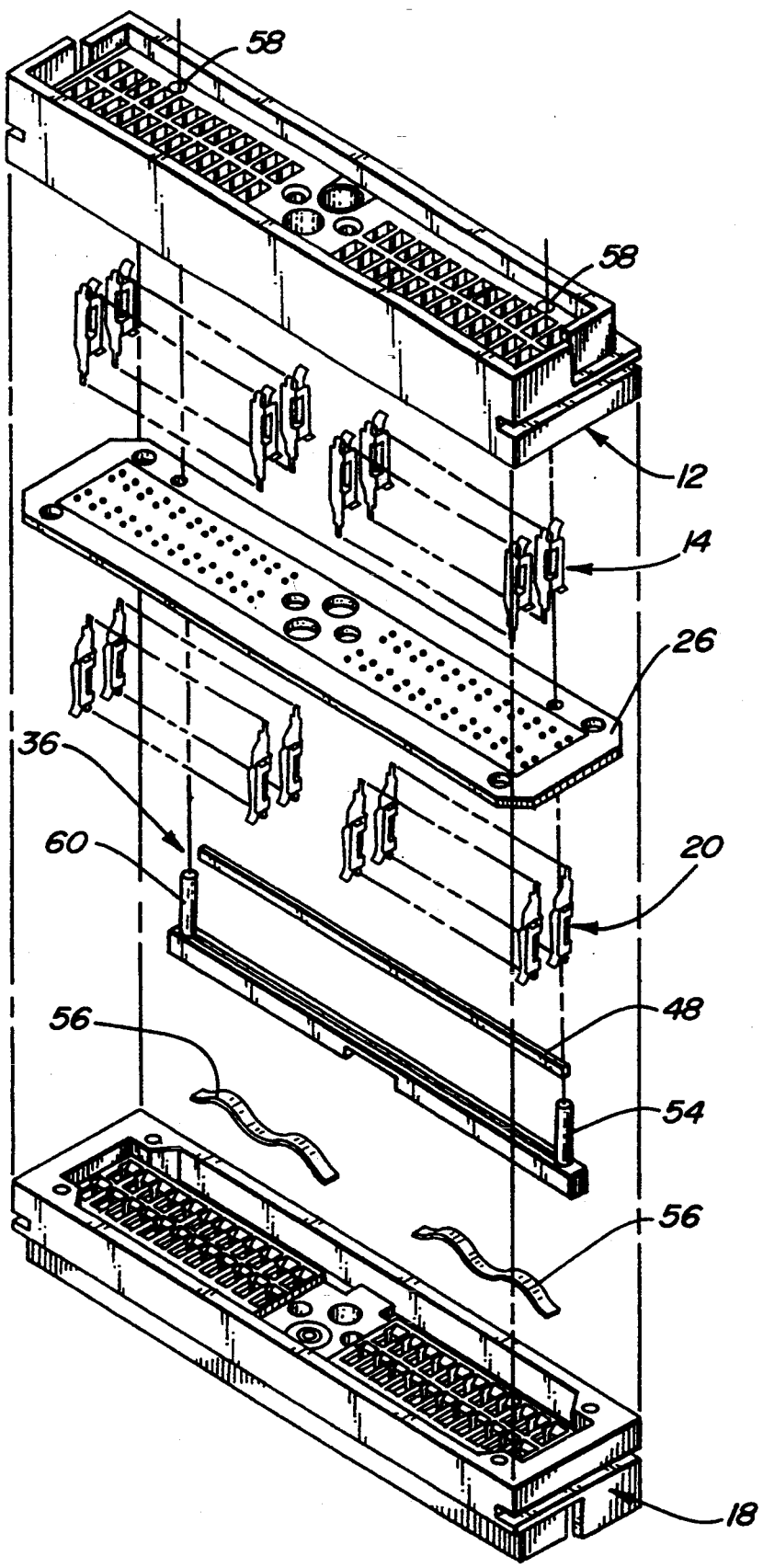
FIG. 2 is a an exploded perspective view of the interposer that is illustrated in FIG. 1, representing a different angle of view.
Figure 5:
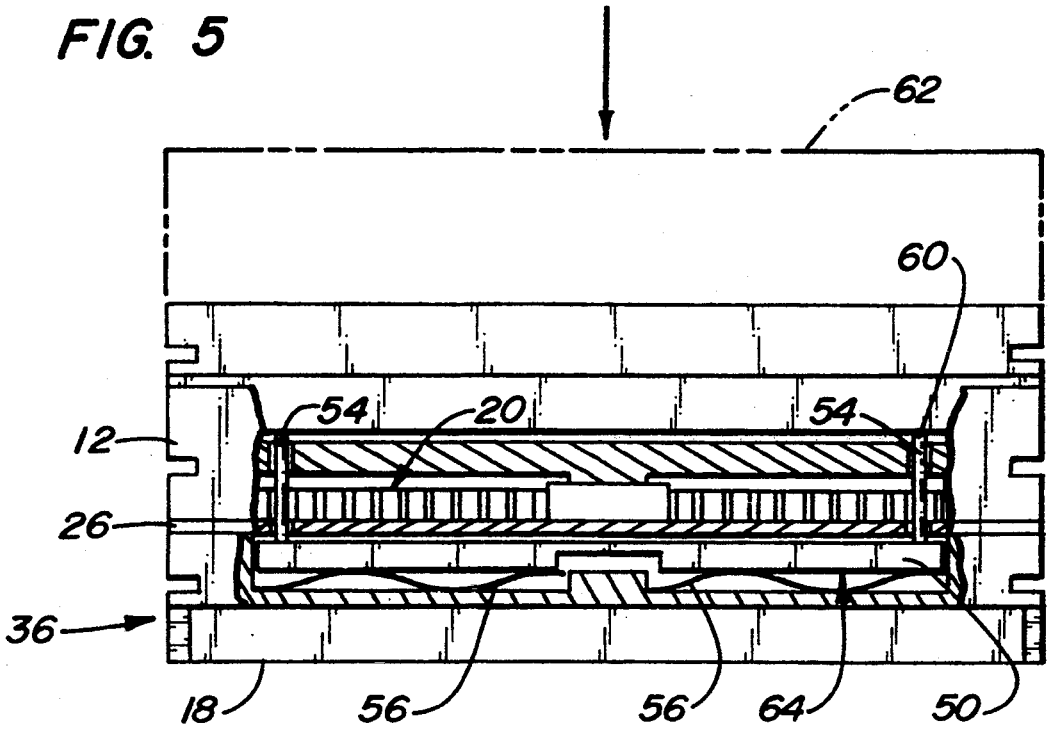
FIGS. 5 is cross-sectional view through one component of the system that is depicted in FIGS. 1–4.

Referring back to FIGS. 1 and 2, grounding system 36 further includes a conductive ground bar 48 that is constructed and arranged to engage the grounding contact area 38 on printed circuit board 26. Grounding bar 48 is preferably fabricated from an elastomeric material having conductive traces deposited thereon, such as those that are commercially available from Fujipoly Co. of Cranford, N. J. As shown in FIG. 1, grounding bar 48 is secured to a grounding bar holder 50. A pair of cam rods 54 extend from grounding bar holder 50 through a pair of holes in printed circuit board 26, and through another pair of holes 58 in first housing 12. Each cam rod 54 has a cam surface 60 defined at its distal end for contacting a surface 64 on a mating connector 62 when the mating connector 62 is connected to the first housing 12, as is shown in FIG. 5. As can best be seen in FIG. 2, a pair of springs 56 are positioned between grounding bar holder 50 and second housing 18 to bias grounding bar holder 50, and thus grounding bar 48, toward the grounding contact area 38 on the printed circuit board 26.

In operation, interposer 10 will ordinarily be mounted to an electronic component such as a central processor of a computer by fastening the second housing 18 to a connector interface on the component. If no mating connector is connected to the first housing 12 and the first plurality of terminals 14, grounding bar 48 will be biased into contact with the grounding contact area 38 of printed circuit board 26 by the action of the springs 56 against the grounding bar holder 50. In this position, grounding bar 48 will electrically connect each of the terminal contacts 40 with the ground contact 42 in the grounding contact area 38. As a result, the first plurality of terminals 14 and the second plurality of terminals 20 will be connected to ground. It should be understood that interposer 10 can alternatively be constructed, through a different configuration of printed circuit board 26 or through a different pattern of conductive material on ground bar 48, so that only selected terminals are connected to ground during the unconnected position.

When a mating connector 62 is positioned adjacent to the first housing 12 of interposer 10 with the intent of establishing a connection, a surface 64 on connector 62 approaches the cam surfaces 60 that are on the ends: of the respective cam rods 54 of grounding system 36. The terminals of the mating connector then penetrate into first housing 12, and a connection is made with the first plurality of terminals 14. Once a secure connection has been made, surface 64 presses against the cam surfaces 60, thereby moving grounding bar holder 50 and grounding bar 48 away from the grounding contact area 38 on printed circuit board 26. At this point, terminals 16, 22 are no longer grounded by the grounding bar 48, and the desired electronic connection between the mating connector and the connector interface is completed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An anti-electrostatic discharge interposer for connecting a mating connector to a connector interface in an electronic system, comprising:

a housing;

a first plurality of terminals supported in said housing, said housing and said first plurality of terminals being constructed and arranged to mate with a mating connector;

a second plurality oft terminals supported in said housing, said housing and said second plurality of terminals being constructed and arranged to mate with a connector interface;

connecting means for electrically connecting said first plurality of terminals, respectively, to said second plurality of terminals in a predetermined relationship, said housing and said connecting means being secured together as an integral unit; and grounding means for electrically connecting at least a group of said connected terminals to ground when said housing is not fully mated to one oft said connector interface or mating connector, said grounding means comprising mechanical means for disconnecting said group of connected terminals from ground when said housing is substantially fully mated to said one of said connector interface or mating connector, said mechanical means comprising a grounding area on said connecting means and an elongated grounding bar that is constructed and arranged to engage said grounding area when said housing is not substantially fully mated to said connector interface or making connector, said grounding bar comprising a conductive elastomeric portion for engaging said contact area whereby any electrostatic discharges will be grounded during connection of the respective connector interface or mating connector to said interposer.

2. An interposer according to claim 1, wherein said connecting means comprises a printed circuit board.

3. An interposer according to claim 1, wherein said grounding means further comprises biasing means for biasing said grounding bar toward said area on said printed circuit board.

4. An interposer according to claim 3, wherein said biasing means comprises at least one spring.

5. An interposer according to claim 1, wherein said mechanical disconnecting means comprises cam means for urging said grounding bar away for said area on said printed circuit board when said cam means engages said one of said first or second housings.

6. An anti-electrostatic discharge electrical connector assembly for connecting to a mating connector, comprising:

a housing;

a plurality of terminals supported in said housing, said housing and said terminals being constructed and arranged to mate with a mating connector; and grounding means for electrically connecting at least a group of said terminals to ground when said connector is not fully mated to a mating connector, said grounding means comprising a printed circuit board that is mounted to said housing, a conductive grounding bar that is constructed and arranged to engage a grounding area on said printed circuit board when said connector assembly is not fully mated to a mating connector, said grounding bar comprising a conductive elastomeric portion for engaging said grounding area in a resilient fashion, whereby any electrostatic discharge will be grounded during connection of said connector assembly to a mating connector.

* * * * *

UNITED STATES PATENT AND TRADEMARK OFFICE

CERTIFICATE OF CORRECTION

PATENT NO. : 5,409,387

DATED : 4/25/95

INVENTOR(S) : William A. Northey, et al

It is certified that error appears in the above-indentified patent and that said Letters Patent is hereby corrected as shown below:

Column 5, Line 3 - "oft" should read "of".

Column 5, Line 15 - "oft" should read "of".

Signed and Sealed this

First Day of August, 1995

Bruce Lehman

*Attest:*

BRUCE LEHMAN

*Attesting Officer*

*Commissioner of Patents and Trademarks*